United States Patent [19]

Henley

[11] Patent Number: 4,836,541

[45] Date of Patent: Jun. 6, 1989

[54] LEAD ARM DEVELOPMENT BAT

[76] Inventor: Douglas R. Henley, Rte. 1, P.O. Box 166, Chunky, Miss. 39323

[21] Appl. No.: 73,215

[22] Filed: Jul. 14, 1987

[51] Int. Cl.[4] ..... A63B 69/40

[52] U.S. Cl. ..... 273/26 B; 273/72 R; 272/124

[58] Field of Search ..... 273/26 B, 67 R, 67 B, 273/67 D, 67 DA, 72 R, 72 A, 84 R; D21/211; 272/123, 124

[56] References Cited

U.S. PATENT DOCUMENTS

| | | | |
|---|---|---|---|
| 442,046 | 10/1890 | Heighington | 273/67 D |
| 443,263 | 12/1890 | Smith | 273/84 R |
| 558,320 | 2/1896 | Solberg | 273/84 |
| 729,639 | 7/1903 | McCoy | 273/72 R |
| 805,132 | 11/1905 | Gubbins | 273/72 R |
| 875,273 | 5/1907 | Kimble | 273/26 B |
| 1,179,611 | 4/1916 | Cilley | 273/84 R |
| 1,676,689 | 11/1928 | Dwyer | 273/84 |
| 2,143,337 | 1/1939 | Walton | 273/84 |
| 2,757,002 | 5/1956 | Ryden | 273/67 |
| 2,966,621 | 12/1960 | Voll | 273/84 R |
| 3,116,926 | 1/1964 | Owen et al. | 273/26 B |
| 3,231,281 | 1/1966 | Vallo | 273/84 R |
| 3,246,894 | 4/1966 | Salisbury | 273/26 B |
| 3,392,976 | 7/1968 | Hayes | 272/124 |
| 3,479,030 | 11/1969 | Merola | 273/72 A |
| 3,729,196 | 4/1973 | Heald, Jr. | 273/72 A |
| 3,809,397 | 5/1974 | Gruenewald | 273/26 B |
| 3,955,816 | 5/1976 | Bratt | 273/26 B |
| 4,098,503 | 7/1978 | Antone | 273/26 B |
| 4,378,113 | 3/1983 | Piccini | 272/124 |

FOREIGN PATENT DOCUMENTS

| | | | |
|---|---|---|---|
| 3989 | 12/1931 | Australia | 273/84 R |
| 2564 | of 1890 | United Kingdom | 273/84 R |
| 554 | of 1898 | United Kingdom | 273/84 R |
| 16565 | of 1902 | United Kingdom | 273/84 R |

*Primary Examiner*—Edward M. Coven
*Assistant Examiner*—T. Brown
*Attorney, Agent, or Firm*—Nixon & Vanderhye

[57] ABSTRACT

A wood or aluminum practice bat designed to be swung by one arm is provided for developing hitting skills. The bat comprises a continuously tapered barrel portion, and a substantially cylindrical handle portion connected by a sharply tapered portion. The handle portion of the bat has a length which effectively permits grasping by only one hand at a time, thus confining the bat for its intended use. The bat, which has an overall length of about twenty-two inches, and weighs about twenty ounces, is intended to be used in various drills designed to facilitate development and coordination of the movements, and muscle groups which control the movements, of each arm individually.

16 Claims, 1 Drawing Sheet

LEAD ARM DEVELOPMENT BAT

BACKGROUND AND SUMMARY OF THE INVENTION

The present invention relates to a unique practice bat for baseball and softball players. The bat is designed for development of the lead arm, i.e., the arm that enters the strike zone first. This is the left arm for right-handed batters, and the right arm for left-handed batters.

There are a number of exercise or warm-up bats currently available. In U.S. Pat. No. 3,392,976, for example, there is disclosed a baseball bat wherein a cylindrical plug or weight is adjustable within a hollow interior chamber formed within the bat for changing its center of gravity. The bat includes an elongated barrel portion for accommodating the cylindrical plug or weight, and includes a relatively short transitional area between the barrel and the handle portion. The bat is constructed in three, separable pieces so that is can readily be disassembled into parts and carried, for example, in a conventional carrying bag for sport equipment.

In U.S. Pat. No. 3,955,816, a warm-up bat is disclosed with a closable, hollow chamber which may be filled with granular weight material. The bat is made in two sections, one section being telescoped into the other and the granular weight material may be added or removed as desired to vary the weight of the bat.

In U.S. Pat. No. 4,098,503, there is disclosed a one-handed bat provided with a strap or cord which serves to attach the bat to the hand or wrist of the user to prevent the bat from slipping out of the batter's grasp. In addition, the bat is formed with a somewhat elliptical, cross-sectional shape so as to provide a greater ball hitting surface than normal. The bat is not designed to develop any batting skills, but rather, it is merely designed to facilitate rapid fire hitting of ground balls to infielders during traditional, pre-gram warm-up practice.

In U.S. Pat. No. 3,809,397, a wind-resistant device is disclosed which is designed to be installed over a baseball bat and to create wind-resistance during swinging in order to develop the muscles that will be utilized during the normal use of the bat.

In U.S. Pat. No. 3,246,894, a baseball training bat is disclosed which is designed for improving the visual acuity and long ball hitting ability of the batter. In this device, a conventional, outer barrel portion is connected to a conventional gripping portion by an elongated central section which is constructed of a considerably smaller diameter than either of the two other portions.

U.S. Pat. No. 3,116,926 discloses a weighted baseball bat wherein a plurality of weights are installed in the barrel end of the bat and are spring-biased to an outermost position. The bat is designed to develop the wrist and forearm of the batter.

The present invention is designed primarily to develop, improve and increase ability in the batter's lead arm. Of the two arms involved in hitting, the arm entering the initial contact zone, i.e., the lead arm, is the more important. In fact, the importance of the lead arm cannot be overemphasized. In this regard, arm extension and wrist rotation are vital in helping to create optimal kinetic energy release upon contact with the ball. In other words, lead arm development is essential for creating the proper force and enabling proper control during the entire swinging stroke. Use of the subject invention helps the lead arm control both arm extension and wrist rotation by improving timing and coordination.

In a related aspect, the practice bat of this invention improves hand/eye coordination, particularly because of the unique size of the bat, which forces the batter to further concentrate on making contact, and thus improves his ability to locate the baseball without having to engage in any kind of thought process. By consistent use of the lead arm development bat, the batter will learn to coordinate the head, shoulder, arms and hips in a proper and coordinated manner which, in turn, will enable the batter to adjust and react to a pitch in a much more successful manner.

In still another aspect, use of the lead arm development bat develops and improves the follow-through of the swing which is important because the longer the ball can remain in contact with the bat, the greater the kinetic energy that can be imparted to the ball. This, of course, determines the velocity and distance transferred to the ball upon impact with the bat.

Perhaps most significantly, the lead arm development bat of this invention provides the opportunity to properly strengthen the muscle groups involved with lead arm development. Thus, repetitious use of the lead arm development bat of this invention develops the triceps which extend the arm, as well as the flexors/extensors that cause the rolling action of the wrist. The precise and optimal coordination of thesé two events is critical to the success of the batter, particularly in terms of the maximization of distance and speed of travel of the ball.

In an exemplary embodiment of the invention, the lead arm development bat comprises a one-piece bat construction including a barrel portion which tapers inwardly from a first diameter to a second diameter, and a handle portion adjacent the second diameter portion of the barrel. The handle is substantially cylindrical throughout its length and terminates in a conventional butt end. A sharply tapered connector portion connects the barrel and handle portions. As a result of this configuration, the lead arm development bat essentially comprises a conventional bat construction but wherein an intermediate portion between the handle and barrel has been removed so as to foreshorten the bat to a considerable extent. Thus, the barrel portion has the diameter and shape of a conventional baseball bat while the handle similarly has the shape and configuration of a conventional baseball bat.

The bat is intended to be used in a variety of practice drills designed to develop the batter's lead arm. It will be understood that during these practice drills, the batter swings the bat with the lead arm only.

Additional objects and advantages will become apparent from the detailed description of the invention which follows.

DETAILED DESCRIPTION OF THE INVENTION

Figure 1:
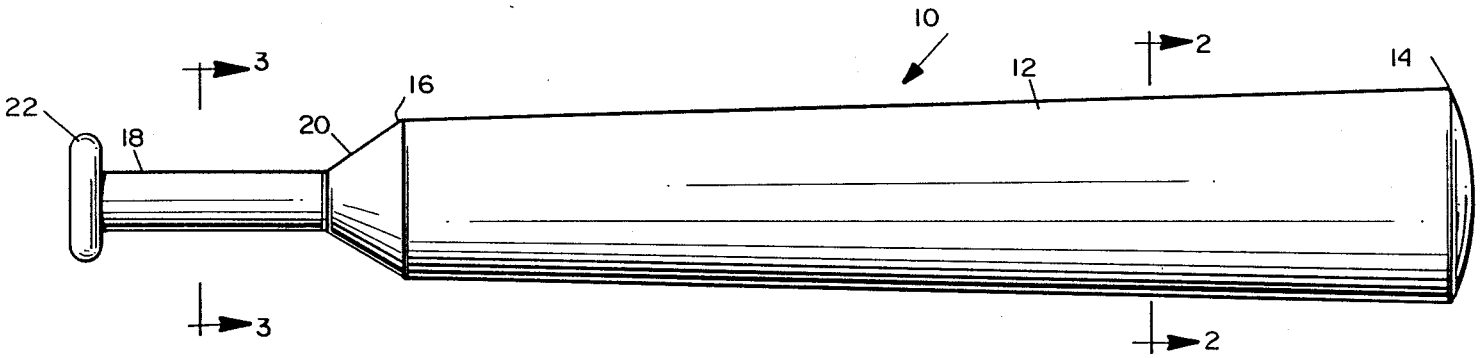
FIG. 1 is a side view of the lead arm development bat of this invention.
Figure 3:
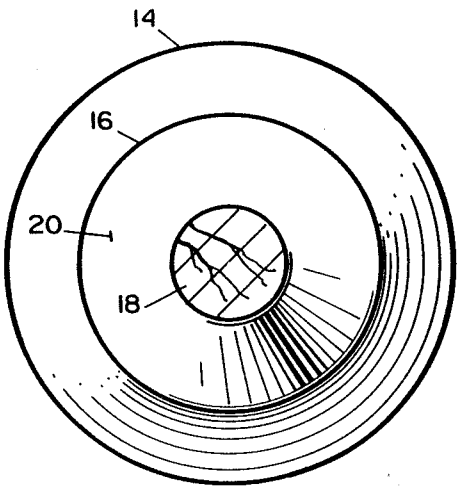
FIG. 3 is a cross-sectional view taken along the line 3—3 of FIG. 1.
Figure 2:
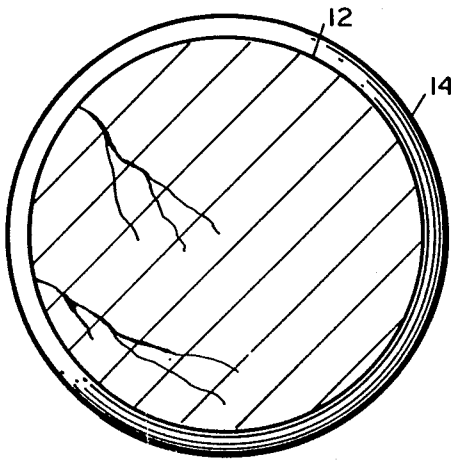
FIG. 2 is a cross-sectional view taken along the line 2—2 of FIG. 1.

With reference now to the drawings, the lead arm development bat 10 includes a barrel portion 12 which tapers inwardly from a forward end 14 to a rearward end 16. The barrel portion 12 is connected to a substantially cylindrical handle portion 18 by a sharply tapered connector portion 20. The handle portion 18 terminates at a butt end 22 which serves as a stop for the batter's hand.

The bat is preferably constructed as a single piece, and may be constructed of the usual hardwoods used in bat construction, such as ash or hickory. Alternatively, the bat may be constructed of a suitable metal such as aluminum. It will be understood, of course, that the bat may be constructed in two or more pieces as well.

In a preferred embodiment, the bat has an overall length of approximately twenty-two inches, which represents a considerable shortening over conventional baseball bats which generally range in length from twenty-eight to thirty-six inches.

The barrel portion of the bat extends approximately fourteen inches from its forward edge 14 to the rearward edge 16, tapering gradually from an outer diameter of about two and one half inches, to an inner diameter of about two inches. The length of the connector portion 20 is approximately two inches and, as illustrated in FIG. 1, tapers sharply between the rearward edge 16 of the barrel portion and the handle portion 18. The preferred weight of the bat is approximately twenty ounces.

The preferred bat construction described hereinabove is designed to be useful for batters of various ages and sizes. However, it will be appreciated that the bat may be constructed in additional sizes and weights consistent with the overall requirements dictated by lead arm development, the ability to be used in confined areas, and the like.

It will be noted that the handle portion of the bat should be maintained in the six inch range in terms of length since this effectively precludes a batter from using two hands and thereby compromising the effectiveness of the bat for its intended purpose.

In use, a right-handed batter, for example, would grip the lead arm development bat in his left hand and swing the bat in normal fashion as though it were gripped in two hands. The length and weight of the bat impart the feel of a conventional bat, but the foreshortened length permits its use in confined areas and in a number of exercise drills where a conventional bat would be otherwise inappropriate.

In addition to the utilization of the bat for lead (or "bottom hand") arm development as described previously hereinabove, it has been found that the bat is also useful in certain exercises and drills designed to aid in the development of the "top hand" arm as well. This is particularly true in the development of the fundamentals of hitting which relate to the concept of "top-hand dominance". This concept relates to the control and guidance provided by the "top hand" arm as the lead, or "bottom hand" arm causes wrist rotation during a swing.

The muscle group activity for development of "top hand dominance" are essentially the same as those required for lead arm development, although differences exist in the transfer and balance of forces generated during a batting stroke. In this regard, bicep development is important and, of course, this development supports the development of the triceps secondarily. Once momentum is created in a batting stroke, the "top hand" arm aids in pushing the hat toward the oncoming ball. The effective transfer of use of the bicep group to the tricep group during the swing enhances bat speed which is critical to good hitting.

Thus, the bat of this invention may also be used by the "top hand" arm only, in various drills including taking normal swings, as though both hands were on the bat.

Accordingly, the uniquely designed bat of this invention is beneficial to the development of the lead arm as well as the "top hand" arm, leading to improved coordination of all arm movements associated with hitting a pitched baseball or softball.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A one-piece batting practice bat for developing the lead arm of a ballplayer comprising:

a barrel portion about fourteen inches in length which tapers continuously inwardly from an outermost edge having a first diameter, to an inner edge having a second diameter; and a handle portion about six inches in length adjacent the second diameter portion of the barrel, wherein the handle portion has a third diameter which is substantially one-half of said second diameter, said barrel and handle portions connected by a relatively short and sharply tapered connector portion.

2. A one-piece batting practice bat as defined in claim 1 wherein said connector portion has a length of about two inches.

3. A one-piece batting practice bat as defined in claim 1 wherein said bat is wood.

4. A one-piece batting practice bat as defined in claim 1 wherein said bat has a weight of about twenty ounces.

5. A one-piece batting practice bat as defined in claim 1 wherein the cross-sectional shape of the bat anywhere along its length is substantially circular.

6. An aluminum batting practice bat for developing the lead arm of a ballplayer comprising a barrel portion approximately fourteen inches long, said barrel portion tapering from a first diameter at an outermost edge to a second diameter at an innermost edge; a handle portion approximately six inches long and having a substantially uniform third diameter approximately one-half the second diameter, and, a sharply tapered portion connecting said barrel and handle portions.

7. A bat as defined in claim 6 wherein the handle portion remote from said sharply tapered portion is formed with an enlarged butt end.

8. A bat as defined in claim 6 wherein said bat has an overall length of about twenty-two inches.

9. A bat as defined in claim 8 wherein the cross-sectional shape of the bat anywhere along its length is substantially circular.

10. A batting practice bat comprising means for developing the lead arm of a ballplayer, said means including a barrel portion tapered from a forward free end to a rearward end;

a connector portion sharply tapering rearwardly and inwardly from the rearward end of the barrel portion; and a handle portion of substantially constant diameter extending rearwardly from the connector portion and terminating at an enlarged end;

wherein said bat is about twenty-two inches in overall length, and said handle portion is about six inches in length.

11. A batting practice bat as defined in claim 10 wherein said connector portion is approximately one-third the length of said handle portion.

12. A batting practice bat as defined in claim 10 wherein said bat is constructed of wood.

13. A batting practice bat as defined in claim 10 wherein said bat is constructed of aluminum.

14. A batting practice bat as defined in claim 10 wherein said connector portion is about two inches in length.

15. A batting practice bat as defined in claim 10 wherein said bat weighs about twenty ounces.

16. A batting practice bat as defined in claim 10 wherein the cross-sectional shape of the bat anywhere along its length is substantially circular.

* * * * *